US006224291B1

(12) United States Patent
Mateychuk

(10) Patent No.: US 6,224,291 B1
(45) Date of Patent: May 1, 2001

(54) SPIKED ROAD BARRIER

(76) Inventor: Jonathon R. Mateychuk, 245 Foch Ave., Winnipeg, Manitoba (CA), R2C 5H9

( * ) Notice: Subject to any disclaimer, the term of this patent is extended or adjusted under 35 U.S.C. 154(b) by 0 days.

(21) Appl. No.: 09/409,224

(22) Filed: Sep. 30, 1999

(30) Foreign Application Priority Data

Oct. 2, 1998 (CA) ..... 2249486
Apr. 9, 1999 (CA) ..... 2268643

(51) Int. Cl.[7] ..... E01F 13/00; E01F 15/00
(52) U.S. Cl. ..... 404/6
(58) Field of Search ..... 404/6, 51; 256/13.1

(56) References Cited

U.S. PATENT DOCUMENTS

| | | | | |
|---|---|---|---|---|
| 3,785,741 | * | 1/1974 | Lodige | 404/51 |
| 4,101,235 | * | 7/1978 | Nelson | 404/6 |
| 4,158,514 | * | 6/1979 | Dickinson | 404/6 |
| 5,253,950 | | 10/1993 | Kilgrow et al. . | |
| 5,288,164 | | 2/1994 | Nasatka . | |
| 5,322,385 | * | 6/1994 | Reisman | 404/6 |
| 5,330,285 | | 7/1994 | Greves et al. . | |
| 5,482,397 | * | 1/1996 | Soleau | 404/6 |
| 5,829,912 | * | 11/1998 | Marcotullio et al. | 404/6 |
| 5,904,443 | * | 5/1999 | Soleau | 404/6 |
| 5,921,703 | * | 7/1999 | Becker et al. | 404/6 |

FOREIGN PATENT DOCUMENTS

| | | |
|---|---|---|
| 2116869 | 9/1992 | (CA) . |
| 2090376 | 2/1993 | (CA) . |
| 2 218 140 | 8/1989 | (GB) . |
| 2 253 430 | 9/1992 | (GB) . |

OTHER PUBLICATIONS

Brochure—Model BG Barrier Gate for Control of Vehicle Traffic—Eastco Manufacturing Corp.
Brochure—Surface Mount Traffic Controller TC8—Eastco Manufacturing Corp.
Brochure—Motorized Traffic Controller—Eastco Manufacturing Corp.
Brochure—Heavy Industrial Duty Swing Gate Operator—Eastco Manufacturing Corp.
Brochure—Gear–Reduced Heavy Industrial Duty Slide Gate Operator—Eastco Manufacturing Corp.
Brochure—Vehicle Arresting and Entrapment Systems—Lt. Cmdr. R.B.W. Lowndes, Londesborough Security Equipment Ltd.

* cited by examiner

*Primary Examiner*—Eileen D. Lillis
*Assistant Examiner*—Gary S. Hartmann
(74) *Attorney, Agent, or Firm*—Adrian D. Battison

(57) ABSTRACT

A spiked road barrier is provided for deflating the tires of a fleeing vehicle. The barrier includes a housing arranged to be mounted within a trench in a roadway. A cover plate is mounted on a top side of the housing such that it is flush with a top side of the roadway. The cover plate includes a plurality of apertures therein, each for receiving a spike therethrough in an armed position. The spikes are mounted on a bar within the housing and extend upward through the apertures in the cover plate in the armed position. The bar may be lowered into an unarmed position such that the spikes do not extend upward past the cover plate using an actuator mounted within the housing. A membrane is coated over the top side of the cover plate to cover the apertures and seal them closed in the unarmed position. When the spiked road barrier is activated, the spikes are displaced upward and pierce through the membrane.

18 Claims, 3 Drawing Sheets

SPIKED ROAD BARRIER

FIELD OF THE INVENTION

This invention relates to a spiked road barrier for deflating the tires of a vehicle passing over the barrier for the purposes of immobilising the vehicle.

BACKGROUND

Barriers for use on roadways are commonly used for security and law enforcement. An example of a situation where a barrier is desired is a high speed pursuit where law enforcement officers desire to immobilise a fleeing vehicle. An effective method that is used to accomplish this task is the use of upstanding spikes or blades on a roadway for piercing the fleeing vehicle's tires in order to deflate the tires and immobilise the vehicle. These devices are generally portable and not meant for long term use, requiring an individual to place and remove the device every time it is to be used.

Known devices which are permanently installed are found in low speed access lanes for parking lots and the like. These devices generally make use of some form of grill having numerous openings for inserting the spikes therethrough. These known devices do not adequately protect the spikes in an unarmed position and may allow tampering with the spikes by unauthorised persons. The devices are also easily tampered with by jamming anything into the openings of the grill. In some known devices a bent spike can easily jam within one of the openings, also resulting in damage to the device. Inadequate covering also results in weather penetration and icing in colder climates.

SUMMARY

According to the present invention there is provided a spiked road barrier for deflating tires of a vehicle wherein the barrier comprises:

- a housing mounted within a trench in a roadway such that a top side of the housing does not extend upward beyond a top side of the roadway;
- an elongate bar mounted within the housing to extend transversely to the roadway;
- a plurality of spikes mounted on the bar;
- a cover member mounted on the top side of the housing for enclosing the housing in an unarmed position wherein the spikes remain below the cover member;
- an actuator for displacing the bar between the unarmed position and an armed position wherein the spikes extend upward past the cover member for engaging the vehicle's tires when the vehicle moves along the roadway such that the vehicle's tires are deflated.

The cover member preferably comprise an elongate plate mounted on the top side of the housing having a plurality of apertures therein, each aperture being arranged to receive one of the spikes therethrough, the apertures being sealed closed in the unarmed position.

There may be provided a membrane extending across a top side of the elongate plate sealing the apertures closed when the spikes are in the unarmed position, the spikes being arranged to extend through the membrane when moved into the armed position.

Preferably there is provided a cap mounted within each aperture, the cap being selectively separable from the cover member such that the spikes remove the respective caps as the spikes are displaced into the armed position, the caps being mounted within the respective apertures in the unarmed position of the spikes as desired.

Each cap may include a resilient flange arranged to extend around a peripheral edge of a respective aperture in the membrane for receiving the cap therein such that the cap forms a seal with the membrane.

There may be provided a flange extending downward from each side of the elongate plate for engaging a corresponding side of the housing to secure the plate onto the housing.

A plurality of reinforcement bars are preferably arranged extend laterally outward from respective sides of the housing for engaging into respective concrete slabs adjacent to the housing which form the roadway.

The plurality of bars associated with one side of the housing are coated to allow minimal displacement between the housing and the corresponding concrete slab so as to form an expansion joint in the roadway.

There may be provided a guide member mounted within the housing for supporting the bar of spikes as it is displaced between the armed and unarmed positions.

The guide member preferably comprises a pair of flanges extending downward into the housing from the top side of the housing, the flanges being arranged to engage respective sides of the bar of spikes.

The actuator preferably comprises a plurality of compressed air activated lifters connected to the bar for moving the bar upward into the armed position.

The lifters are preferably mounted below the bar at respective locations in alignment with a path travelled by the vehicle's tires such that extension of the lifters will push the bar upward and retraction of the lifters will pull the bar down.

There may be provided a remote control means mounted within the housing and connected to the actuator such that the spikes can be displaced into the armed position from a remote location.

A portion of the spikes are preferably tubular having a piercing portion at a top end which is pointed.

Preferably the spikes are selectively separable from the bar such that the spikes remain engaged within the tires of the vehicle as the vehicle passes, the spikes being hollow tube members for deflating the tires therethrough.

There may be provided at least one notch in the side of each spike spaced upward from a bottom end of the spike, the notch being arranged to engage the tire for further gripping the tire.

There may be provided a centre spike mounted within each hollow tube member, the centre spike being fixed to the bar such that the tube member is plugged as spike pierces the tire and the tube member freely permits air to pass therethrough when the member is detached from the bar and remains engaged with the tire of the vehicle.

There may be provided a frangible portion near a base of each spike such that the vehicle's tires will break off an upper portion of the spike and the spike will remain engaged in the tire.

The frangible portion preferably comprises at least one notch in a side of each spike adjacent a bottom end of the spike such that the spike will break off when the spike pierces a tire.

The spikes may include a plurality of selectively separable hollow tube members and a plurality of fixed solid members, the hollow tube members and the solid members being mounted along the bar in an alternating arrangement.

BRIEF DESCRIPTION OF THE DRAWINGS

In the accompanying drawings, which illustrate an exemplary embodiment of the present invention.

DETAILED DESCRIPTION

Figure 1:
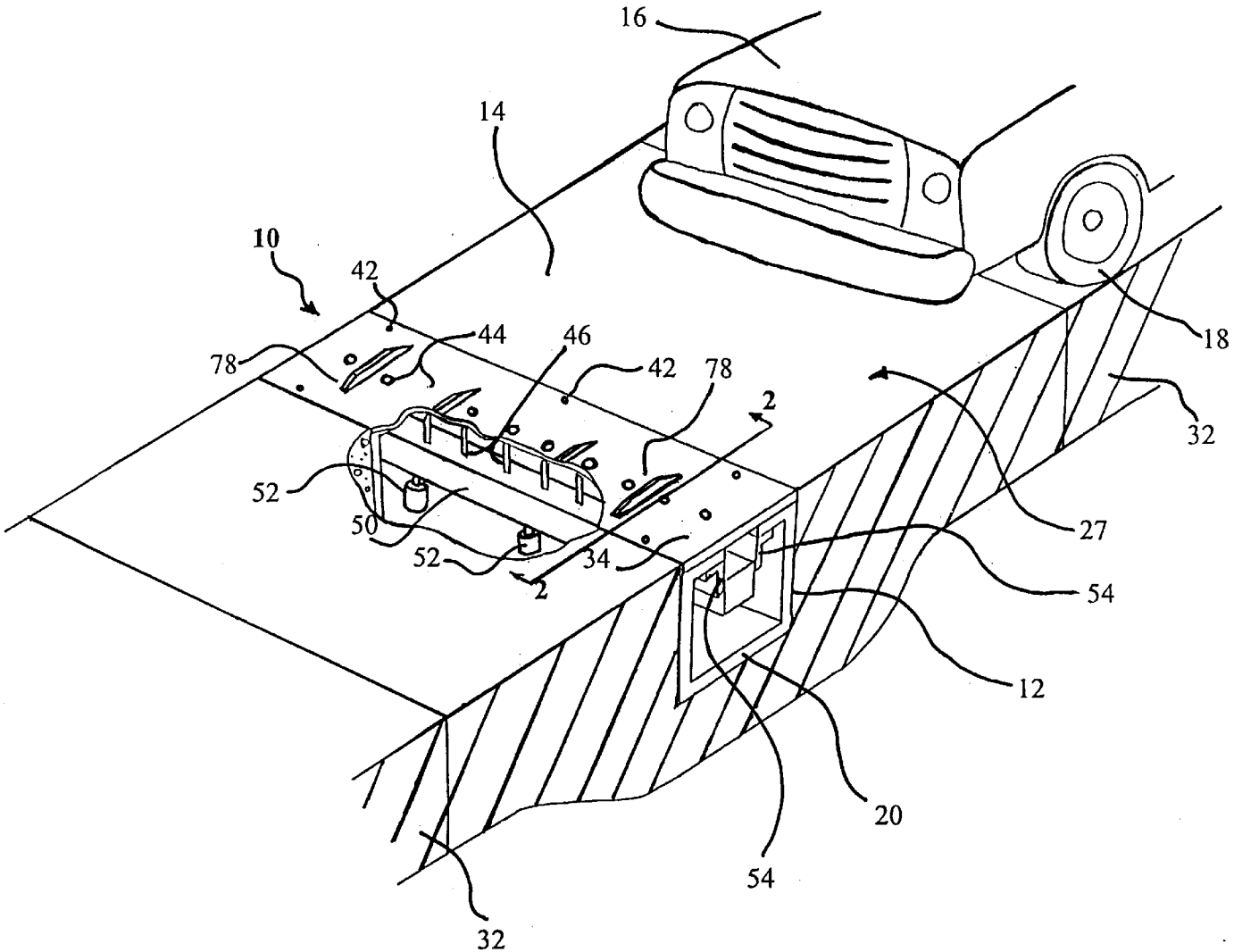
FIG. 1 is an isometric view of the road barrier installed in a roadway.

Referring to the accompanying drawings, there is illustrated a spiked road barrier generally indicated by the number 10. The barrier 10 is arranged to be mounted within a trench 12 in a roadway 14. A vehicle 16 on the roadway passing over the barrier will have its tires 18 deflated when the barrier is in an armed position for disabling the vehicle. The spiked road barrier is particularly useful in high traffic areas for safely disabling vehicles which are fleeing from pursuit or driving unsafely and law enforcement officials wish to apprehend the vehicle.

The barrier 10 includes a housing 20 which is an elongate tubular member having a rectangular cross section and an elongate opening 22 located longitudinally along a top side 24 of the housing for accessibility to the interior of the housing from the top side. The opening 22 is defined between a pair of lateral flanges 25 extending inwardly from respective sides 26 of the housing along the top side 24 to an inner end spaced from the opposite lateral flange 25. The housing 20 is mounted below a top surface 27 of the roadway extending perpendicularly to the direction of vehicle traffic on the roadway.

A plurality of reinforcing bars 28 extend laterally outward from the respective sides 26 of the housing for engaging a surrounding casing 29 of concrete between a pair of concrete slabs 32. The concrete slabs 32 form part of the roadway and mount the barrier 10 and the casing of concrete therebetween. The casing 29 of concrete is poured around the bars and the housing when the barrier is installed such that the barrier forms a joint between the slabs 32. Additional reinforcing bars 28 are connected between each end of the casing 29 of concrete and the respective concrete slabs 32.

This can also be retrofits with the concrete slabs being drilled to receive the reinforcing bars 28. The bars 28 on one end of the casing includes ridges thereon for further securing the bars to the concrete. The bars 28 on the opposite end of the casing as well as a spacing between the casing and the corresponding concrete slab 32 are coated within a deformable coating such as tar or rubber to permit small relative displacement between the casing and the corresponding concrete slab. The casing 29 thus forms an expansion joint in the concrete roadway that is able to accommodate for any thermal expansion or contraction due to the climate.

A cover plate 34 mounts on the top side of the housing to enclose the opening 22. The cover plate 34 is a rectangular plate equal in length to the housing but slightly wider so as to define edges 36 extending past each side 26 of the housing. A flange 38 extends downward from each edge 36 along the corresponding side 26 for engaging the side of the housing and securing the cover plate 34 on the top side of the housing against any lateral displacement. A gasket 39 extends around the flange 38 from the top side of the cover plate for weatherproofing the seam between the cover plate and surrounding concrete. The cover plate 34 is secured from a top side 40 by a plurality of machine screws 42 extending into the housing. The machine screws are recessed into the cover plate so as to be substantially flush with the top side 40. The top side 40 of the housing is substantially flush with the top surface of the roadway.

The cover plate includes a plurality of apertures 44 extending therethrough. The apertures 44 are spaced along the length of the plate in a row which extends perpendicularly to the direction of traffic across the road. Each aperture is arranged to receive a spike 46 therethrough in the armed position for deflating the vehicle's tires.

A membrane 48 is located across the top side of the cover plate for weather proofing the housing. The membrane 48 extends over the apertures 44 such that the interior of the housing is inaccessible to tampering. The membrane 48 is a durable plastic or rubber coating which resists tampering.

Corresponding circular apertures are cut into the membrane in alignment with each aperture 44 of the cover plate. A plastic cap 47 is mounted over each aperture and is retained in place by a flange 49 which extends around a peripheral edge of the corresponding aperture in the membrane. The flange 49 and the peripheral edge of the corresponding aperture in the membrane are both resilient enough to allow the cap to clip into place as desired. The caps are easily popped off by the spikes as the spikes are raised into the armed position. The caps must then be replaced once the spikes are again lowered into the unarmed position by pushing the caps down over the respective apertures until the flanges 49 extend over the corresponding peripheral edges of the apertures in membrane.

The spikes 46 are supported on a bar 50 within the housing such that the spikes may be displaced simultaneously between an unarmed position below the cover plate and an armed position extending upwardly past the cover plate and piercing the membrane. The bar 50 is an elongate bar of rectangular cross section which mounts the spikes thereon at spaced locations corresponding to respective apertures in the cover plate.

Figure 2:
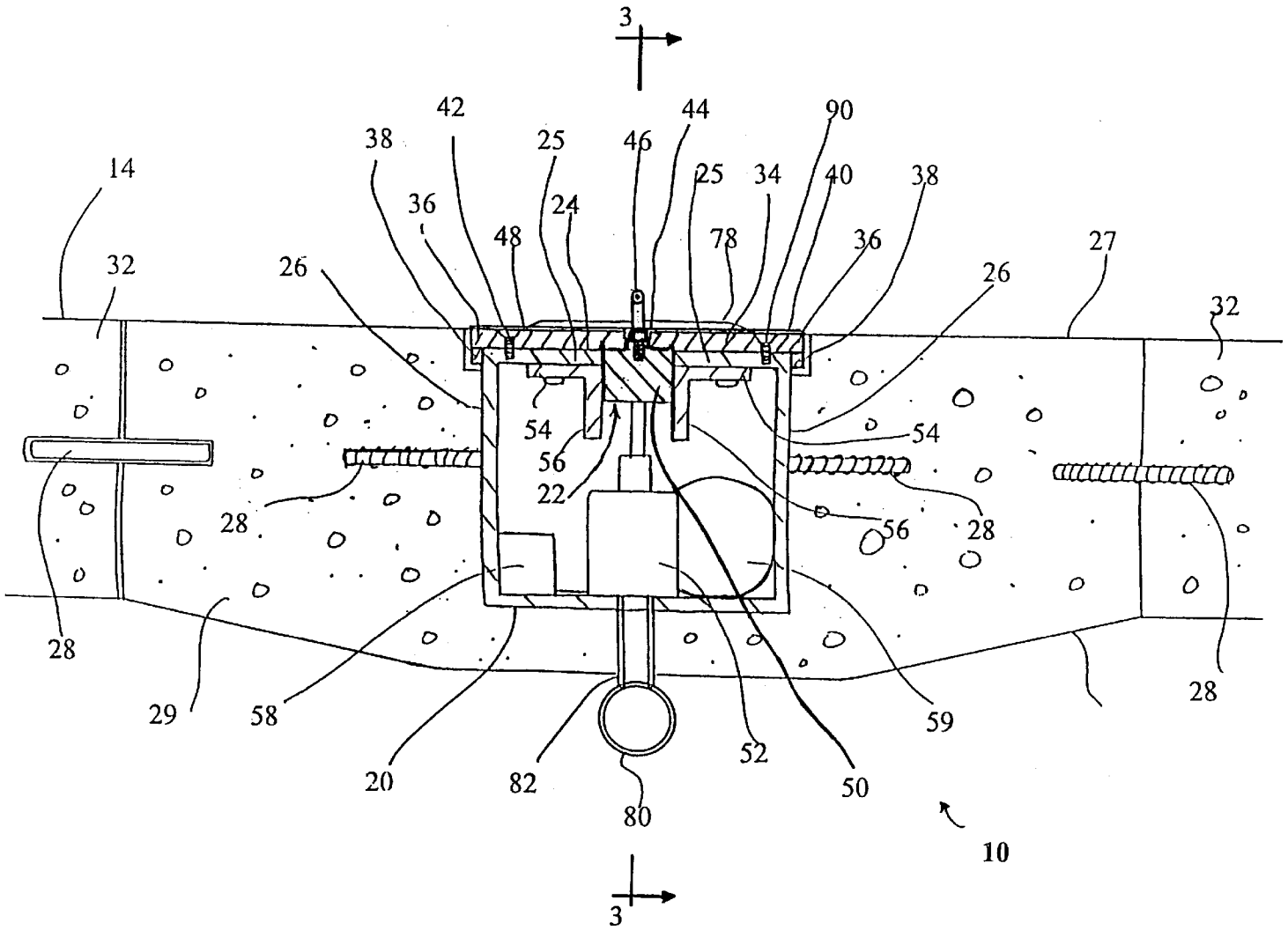
FIG. 2 is a cross sectional view along the line 2—2 of FIG. 1 with the spikes in the armed position.
Figure 3:
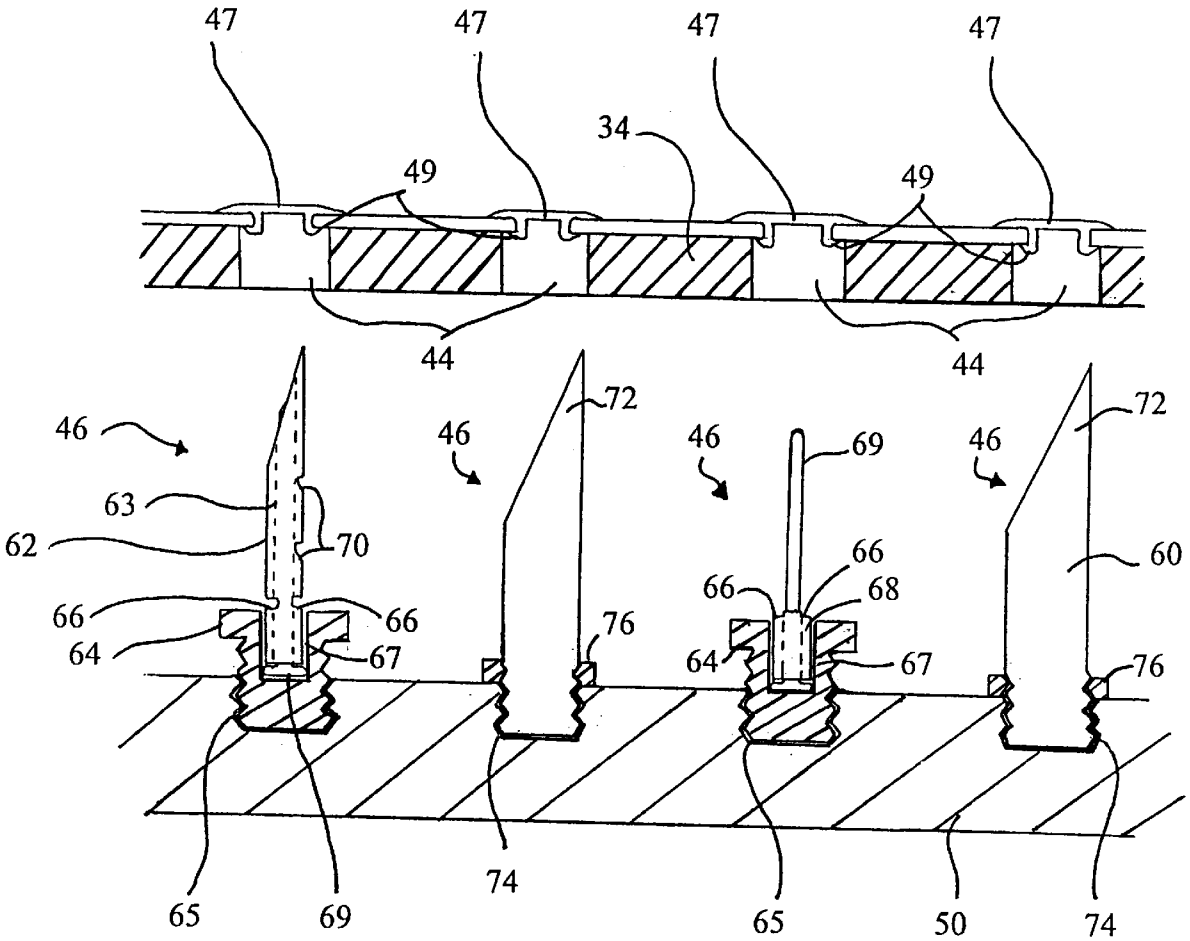
FIG. 3 is an enlarged cross sectional view along the line 3—3 of FIG. 2 showing one of the spikes in the unarmed position.

The bar 50 is mounted within the housing for vertical displacement between the unarmed position shown in FIG. 3 and the armed position shown in FIG. 2. A pair of actuators 52 are mounted within the housing below the bar 50 in alignment with a path followed by the vehicle's tires. The actuators are arranged to be activated in unison to raise or lower the bar such that the bar remains horizontal within the housing.

A pair of guides 54 are mounted on the respective lateral flanges on the top side of the housing for guiding and supporting the bar 50 as it is displaced. Each guide is an elongate member of L-shaped cross section having a side mounted adjacent a bottom side of the lateral flange with fasteners and downward flange 56 extending downward from the side. The downward flanges 56 are parallel and spaced apart on opposite sides of the opening 22 in the housing such that the bar 50 fits therebetween being supported on each side by a corresponding one of the flanges.

The actuators 52 are low profile lifters which are operated by a control box 58 which receives signals from a remote source for activating the actuators. The remote signal can either arm or disarm the spikes. Extension and retraction of the lifters mounted below the bar will respectively raise and lower the bar. The lifters are activated by compressed air which is stored in a tank 59 mounted within the housing.

Within the control box 58 is a solenoid valve having an inlet for receiving pressurised air from the tank 59. A first outlet of the solenoid valve communicates with a first port on the lifters for raising the bar while a second outlet communicates with a second port on the lifters for lowering the bar. The solenoid valve is controlled by a receiver which transmits an appropriate raising or lowering signal to the solenoid valve. The receiver may be located outside of the housing of the road barrier within a roadside beacon. The receiver is arranged to receive signals from a remote transmitter. The remote transmitter may be of any type capable of transmitting a coded signal for arming and disarming the road barrier via a radio signal or other.

The spikes 46 are spaced longitudinally along the bar 50 in an alternating arrangement between solid spikes 60 and hollow spikes 62 along the bar.

The hollow spikes 62 each include an upper piercing portion 63, a gripping portion 64 and a lower threaded portion 65. The piercing portion 63 is a tubular member having a hollow interior. The upper end of the piercing portion is cut on a angle so as to produce a sharp point for piercing through the tire. The gripping portion 64 is located below the piercing portion and has a hexagonal cross section for gripping with a wrench or other similar tool. The threaded portion 65 is below the gripping portion for threading into the bar 50 for mounting the spike on the bar.

Each hollow spike 62 also includes a pair of notches 66 therein forming a frangible section at a bottom end of the piercing portion such that the spike is easily broken off by a passing vehicle once the spike has penetrated the tire. The notches 66 are cut into a front side and back side of the spike. This weakens the spike to easily bend and break in the direction of travel of the vehicle to ensure the spike is broken off after the spike has penetrated the tire as the vehicle passes.

The upper piercing portion 63 is slidably received in a bore 67 with minimal clearance therebetween such that a broken end 68 of the spike can be removed and replaced with a new spike after use. A centre spike 69 extends longitudinally within the upper piercing portion 63 and includes a lower flange which extends around a bottom end of the piercing portion 63 such that the centre spike 69 remains engaged with the broken end 68 in the bore 67 after the vehicle has passed and broken off the main portion of the upper piercing portion which remains stuck in the tire.

An additional pair of notches 70 are provided on each spike 62 for gripping the tire once the spike has partially pierced the tire to ensure the spike will remain engaged in the tire. The additional notches 70 are preferably located spaced upward from the bottom end of the spike toward the top end.

The solid spikes 60 each include a solid member having a pointed upper end 72 and a threaded bottom end 74 for threading into a threaded aperture in the bar. A threaded collar 76 fastens about the threaded bottom end 74 for engaging the top face of the bar. Tightening the collar 76 will lock the orientation of the solid spike in a fixed location such that the pointed end is aligned for most effectively piercing the tires of a passing car. The solid spikes 60 are larger in diameter than the hollow spikes and remain fixed to the bar for tearing a hole in the tires of the passing vehicle.

When the spikes are raised into the armed position, the spikes are positioned such that the gripping portion extends upward slightly past the top side of the cover plate. It is useful for the gripping portion to extend upward past the top side of the cover plate such that it is accessible with a tool. The spikes may then be interchanged if broken or defective without the need to remove the entire cover plate.

When the spikes are lowered into the unarmed position as shown in FIG. 3, the entire spike is lowered below the cover plate such that it is protected from any tampering. The caps may then be replaced to cover the respective apertures once the spikes have cleared the apertures. The membrane and the caps protect the housing from the collection of water and other debris.

Ribs 78 are mounted on a top side of the cover plate between apertures and oriented in the direction of vehicle traffic. The ribs protect the membrane over the apertures from excessive wear by regular vehicle traffic while the barrier is disarmed.

A drain pipe 80, similar to conventional underground drain pipes for roadways, is mounted beneath the housing and includes a plurality of ports 82 connected between the housing and the drain pipe.

In further embodiments, the hydraulic lifters are mounted horizontally within the housing using linkages to displace the bar of spikes upward for use when space constraints must be considered. The membrane may also comprises a continuous member extending across the apertures and being deformable such that the spikes pierce through the membrane as they are raised into the armed position. The membrane is then able to recover its original form as the spikes are lowered for covering the apertures. The cover plate and membrane may be replaced by any type of solid member or plate which covers the openings in the housing when the spikes are in an unarmed position. In this arrangement, the solid member is displaced by a linkage when the spikes are displaced into the armed position.

In further embodiments the actuators may be lifters activated by hydraulics connected to the control box.

Also in further embodiments, the spikes are detachably mounted by mounting the spike within a rubber bushing on the bar or other similar arrangement rather than having a frangible section on the spikes. Some of the spikes may be arranged to remain fixed in the bar and are designed to remove a plug of rubber from the tire rather than just piercing it. This is accomplished by using a tubular spike of relatively large diameter.

For use in various climates, further embodiments of the barrier include electrically heated components for operation in extreme cold and a pumping arrangement for removing collected water and debris from the housing.

While some embodiments of the present invention have been described in the foregoing, it is to be understood that other embodiments are possible within the scope of the invention. The invention is to be considered limited solely by the scope of the appended claims.

What is claimed is:

1. A spiked road barrier for deflating tires of a vehicle wherein the barrier comprises:

a housing mounted across a roadway;

an elongate bar mounted within the housing to extend transversely to the roadway;

a plurality of spikes mounted on the bar;

a cover member mounted on the top side of the housing having a plurality of apertures therein, each aperture being arranged to receive one of the spikes therethrough, the apertures being sealed closed in an unarmed position wherein the spikes remain below the cover member;

an actuator for displacing the bar between the unarmed position and an armed position wherein the spikes extend upward past the cover member for engaging the vehicle's tires when the vehicle moves along the roadway such that the vehicle's tires are deflated.

2. The spiked road barrier according to claim 1 wherein there is provided a remote control means mounted within the housing and connected to the actuator such that the spikes can be displaced into the armed position from a remote location.

3. The spiked road barrier according to claim 1 wherein there is provided a membrane extending across a top side of the elongate plate sealing the apertures closed when the spikes are in the unarmed position, the spikes being arranged to extend through the membrane when moved into the armed position.

4. The spiked road barrier according to claim 1 wherein there is provided a cap mounted within each aperture, the cap being selectively separable from the cover member such that the spikes remove the respective caps as the spikes are displaced into the armed position, the caps being mounted within the respective apertures in the unarmed position of the spikes as desired.

5. The spiked road barrier according to claim 4 wherein each cap includes a resilient flange arranged to engage a peripheral edge of a respective aperture in the cover member for receiving the cap therein such that the cap forms a seal with the cover member.

6. The spiked road barrier according to claim 1 wherein there is provided a flange extending downward from each side of the cover member for engaging a corresponding side of the housing to secure the plate onto the housing.

7. The spiked road barrier according to claim 1 wherein the housing is mounted within a trench in the roadway and there is provided a plurality of reinforcement bars extending laterally outward from respective sides of the housing for engaging into respective concrete slabs adjacent to the housing which form the roadway.

8. The spiked road barrier according to claim 7 wherein the plurality of bars associated with one side of the housing are coated to allow minimal displacement between the housing and the corresponding concrete slab so as to form an expansion joint in the roadway.

9. The spiked road barrier according to claim 1 wherein there is provided a guide member mounted within the housing for supporting the bar of spikes as it is displaced between the armed and unarmed positions.

10. The spiked road barrier according to claim 9 wherein the guide member comprises a pair of flanges extending downward into the housing from the top side of the housing, the flanges being arranged to engage respective sides of the bar of spikes.

11. The spiked road barrier according to claim 1 wherein the actuator comprises a plurality of compressed air activated lifters connected to the bar for moving the bar upward into the armed position.

12. The spiked road barrier according to claim 1 wherein the spikes are selectively separable from the bar such that the spikes remain engaged within the tires of the vehicle as the vehicle passes, the spikes being hollow tube members for deflating the tires therethrough.

13. The spiked road barrier according to claim 12 wherein there is provided at least one notch in the side of each spike spaced upward from a bottom end of the spike, the notch being arranged to engage the tire for further gripping the tire.

14. The spiked road barrier according to claim 1 wherein the spikes are tubular having a piercing portion at a top end which is pointed.

15. The spiked road barrier according to claim 1 wherein the spikes comprise a plurality of selectively separable hollow tube members and a plurality of fixed solid members, the hollow tube members and the solid members having interchangeable mounting means for mounting the spikes on the bar.

16. A spiked road barrier for deflating tires of a vehicle wherein the barrier comprises:

a housing mounted within a trench in a roadway;

an elongate bar mounted within the housing to extend transversely to the roadway;

a plurality of spikes mounted on the bar;

a cover member mounted on the top side of the housing for enclosing the housing in an unarmed position wherein the spikes remain below the cover member;

a plurality of compressed air activates lifters connected to the bar for displacing the bar between the unarmed position and an armed position wherein the spikes extend upward past the cover member for engaging the vehicle's tires when the vehicle moves along the roadway such that the vehicle's tires are deflated, the lifters being mounted below the bar at respective locations in alignment with a path travelled by the vehicle's tires.

17. A spiked road barrier for deflating tires of a vehicle wherein the barrier comprises:

a housing arranged to be mounted across a roadway;

an elongate bar mounted within the housing to extend transversely to the roadway;

a plurality of spikes supported on the bar, each spike including:

a base portion mounted on the bar, the base portion being selectively separable from the bar for replacement thereof;

a tubular piercing portion supported on the base portion and arranged to penetrate the tires of the vehicle;

a frangible portion mounting the tubular piercing portion on the base portion such that the tubular piercing portion can be broken from the base portion; and a centre spike mounted within the tubular piercing portion, the centre spike being fixed to the bar such that the tubular piercing portion is plugged by the centre spike when the tubular piercing portion is supported on the base portion and the centre spike remains fixed on the bar when the tubular piercing portion is broken from the base portion; and an actuator for displacing the bar and the spikes supported thereon between an unarmed position within the housing and an armed position in which the spikes extend upward from the housing for engaging the tires of the vehicle when the vehicle moves along the roadway such that the tires of the vehicle are deflated by the spikes.

18. The spiked road barrier according to claim 17 wherein the frangible portion comprises at least one notch in a side of each piercing portion above the base portion of the spike.

* * * * *